US011986058B2

(12) United States Patent
Beers et al.

(10) Patent No.: US 11,986,058 B2
(45) Date of Patent: May 21, 2024

(54) LACE ROUTING PATTERN OF A LACING SYSTEM FOR AN ARTICLE OF FOOTWEAR

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/083,464

(22) Filed: Oct. 29, 2020

(65) Prior Publication Data

US 2021/0037921 A1 Feb. 11, 2021

Related U.S. Application Data

(63) Continuation of application No. 16/279,064, filed on Feb. 19, 2019, now abandoned, which is a continuation of application No. 15/070,173, filed on Mar. 15, 2016, now Pat. No. 10,244,822.

(51) Int. Cl.

| | |
|---|---|
| ***A43C 11/16*** | (2006.01) |
| ***A43C 1/00*** | (2006.01) |
| ***A43C 11/00*** | (2006.01) |

(52) U.S. Cl.

CPC ..... *A43C 11/165* (2013.01); *A43C 1/00* (2013.01); *A43C 1/003* (2013.01); *A43C 11/008* (2013.01)

(58) Field of Classification Search

CPC ..... A43C 11/165; A43C 11/20; A43C 11/004; A43C 11/008; A43C 9/06; A43C 1/00; A43C 1/003; A43C 1/06; A43C 7/00; A43C 3/0005; Y10T 24/3726; Y10T 24/3713; Y10T 24/3703; Y10T 24/37

See application file for complete search history.

(56) References Cited

U.S. PATENT DOCUMENTS

| | | | | |
|---|---|---|---|---|
| 49,854 A | | 9/1865 | Burchardt | |
| 1,067,323 A | | 7/1913 | Dresler | |
| 1,458,088 A | * | 6/1923 | Unnold | A43C 7/00 24/713 |

(Continued)

FOREIGN PATENT DOCUMENTS

| | | |
|---|---|---|
| CN | 1794928 | 6/2006 |
| CN | 101193568 | 6/2008 |

(Continued)

OTHER PUBLICATIONS

"U.S. Appl. No. 16/279,064, Final Office Action dated May 2, 2022", 14 pgs.

(Continued)

*Primary Examiner* — Jocelyn Bravo
(74) *Attorney, Agent, or Firm* — Schwegman, Lundberg & Woessner, P.A.

(57) ABSTRACT

A lace routing pattern for a lacing system for an article of footwear is described. The lacing system is moved between opened and closed positions by applying tension to segments of a lace connected to a tensioning assembly of a tensioning system. Each of the lace segments are arranged to extend between opposite sides of a lacing area according to a different lace routing pattern. The lace routing patterns have equal total closure distances for each of the lace segments so that tension applied by the tensioning system will be uniformly distributed through the lacing system and the article of footwear.

10 Claims, 12 Drawing Sheets

(56) References Cited

U.S. PATENT DOCUMENTS

| | | | | |
|---|---|---|---|---|
| 3,296,669 | A | 1/1967 | Elder, Jr. | |
| 3,800,444 | A | 4/1974 | Young | |
| RE31,052 | E | 10/1982 | Adams | |
| 4,616,432 | A | 10/1986 | Bunch et al. | |
| 4,942,678 | A | 7/1990 | Gumbert | |
| 5,129,130 | A | 7/1992 | Lecouturier | |
| 5,158,428 | A | 10/1992 | Gessner et al. | |
| 5,345,697 | A * | 9/1994 | Quellais | A43C 1/00 24/712 |
| 5,461,801 | A | 10/1995 | Anderton | |
| 5,640,785 | A | 6/1997 | Egelja | |
| 5,755,044 | A | 5/1998 | Veylupek | |
| 5,848,457 | A | 12/1998 | Silagy | |
| 5,934,599 | A | 8/1999 | Hammerslag | |
| 6,029,376 | A | 2/2000 | Cass | |
| 6,073,370 | A | 6/2000 | Okajima | |
| 6,219,891 | B1 | 4/2001 | Maurer et al. | |
| 6,367,169 | B1 | 4/2002 | Barret | |
| 6,467,193 | B1 | 10/2002 | Okajima | |
| 6,502,329 | B1 | 1/2003 | Silagy | |
| 6,513,211 | B1 | 2/2003 | Fisher | |
| 6,691,433 | B2 | 2/2004 | Liu | |
| 6,871,423 | B2 | 3/2005 | King, Jr. | |
| 6,941,683 | B2 | 9/2005 | Freed | |
| 6,952,890 | B1 | 10/2005 | Blakeslee | |
| 7,281,341 | B2 | 10/2007 | Reagan et al. | |
| 7,752,774 | B2 | 7/2010 | Ussher | |
| 7,958,654 | B2 | 6/2011 | Reagan et al. | |
| 8,046,937 | B2 | 11/2011 | Beers et al. | |
| 8,474,157 | B2 | 7/2013 | Motawi et al. | |
| 8,707,584 | B2 | 4/2014 | Seliger | |
| 8,713,820 | B2 | 5/2014 | Kerns et al. | |
| 8,904,672 | B1 | 12/2014 | Johnson | |
| 9,700,101 | B2 | 7/2017 | Lovett et al. | |
| 9,743,714 | B2 | 8/2017 | Hammerslag et al. | |
| 10,244,822 | B2 | 4/2019 | Beers et al. | |
| 2003/0051374 | A1 | 3/2003 | Freed | |
| 2003/0150135 | A1* | 8/2003 | Liu | A43B 11/00 36/50.1 |
| 2003/0204938 | A1 | 11/2003 | Hammerslag | |
| 2005/0081403 | A1 | 4/2005 | Mathieu | |
| 2005/0102861 | A1 | 5/2005 | Martin | |
| 2005/0166426 | A1 | 8/2005 | Donnadieu et al. | |
| 2006/0005429 | A1 | 1/2006 | Min | |
| 2006/0070261 | A1 | 4/2006 | Reagan et al. | |
| 2006/0075659 | A1 | 4/2006 | Reagan et al. | |
| 2006/0156584 | A1 | 7/2006 | Johnson | |
| 2007/0105489 | A1 | 5/2007 | Barous | |
| 2007/0130799 | A1 | 6/2007 | Seliger et al. | |
| 2008/0301919 | A1 | 12/2008 | Ussher | |
| 2008/0307673 | A1 | 12/2008 | Johnson | |
| 2011/0030244 | A1 | 2/2011 | Motawi et al. | |
| 2011/0232132 | A1 | 9/2011 | Reagan et al. | |
| 2013/0152425 | A1 | 6/2013 | Borel | |
| 2013/0318820 | A1 | 12/2013 | Kishino | |
| 2014/0068838 | A1 | 3/2014 | Beers et al. | |
| 2014/0082963 | A1 | 3/2014 | Beers | |
| 2014/0123449 | A1 | 5/2014 | Soderberg et al. | |
| 2014/0259761 | A1 | 9/2014 | Linth | |
| 2015/0059206 | A1 | 3/2015 | Lovett et al. | |
| 2015/0096193 | A1 | 4/2015 | Senegal | |
| 2015/0313318 | A1 | 11/2015 | Gibb et al. | |
| 2015/0342302 | A1 | 12/2015 | Hahnenberger et al. | |
| 2015/0342304 | A1 | 12/2015 | Modena et al. | |
| 2015/0359296 | A1 | 12/2015 | Gulla | |
| 2017/0105489 | A1* | 4/2017 | Lovett | A43C 11/20 |
| 2017/0119104 | A1 | 5/2017 | Soderberg et al. | |
| 2017/0215524 | A1 | 8/2017 | Rushbrook et al. | |
| 2017/0265573 | A1 | 9/2017 | Beers et al. | |
| 2017/0265575 | A1 | 9/2017 | Beers et al. | |
| 2017/0265576 | A1 | 9/2017 | Beers et al. | |
| 2017/0354207 | A1 | 12/2017 | Signori | |
| 2018/0153260 | A1 | 6/2018 | Beers | |
| 2018/0153263 | A1 | 6/2018 | Beers et al. | |
| 2019/0254383 | A1 | 8/2019 | Beers et al. | |
| 2021/0037922 | A1 | 2/2021 | Beers et al. | |
| 2021/0037923 | A1 | 2/2021 | Beers et al. | |

FOREIGN PATENT DOCUMENTS

| | | |
|---|---|---|
| CN | 101784210 | 7/2010 |
| CN | 104582519 | 4/2015 |
| CN | 104822284 | 8/2015 |
| CN | 109152450 | 1/2019 |
| CN | 109152450 | 12/2020 |
| CN | 112545102 | 3/2021 |
| EP | 3429408 | 2/2024 |
| JP | 2004222782 | 8/2004 |
| WO | 2017160881 | 9/2017 |

OTHER PUBLICATIONS

"U.S. Appl. No. 16/279,064, Response filed Feb. 2, 2022 to Non Final Office Action dated Aug. 2, 2021", 8 pgs.
"U.S. Appl. No. 17/083,475, Restriction Requirement dated May 4, 2022", 6 pgs.
"U.S. Appl. No. 17/083,492, Restriction Requirement dated May 4, 2022", 6 pgs.
"Chinese Application Serial No. 202011299277.0, Office Action dated Apr. 24, 2022", With English translation, 12 pgs.
"Chinese Application Serial No. 202011299277.0, Response filed Mar. 16, 2022 to Office Action dated Sep. 1, 2021", With English claims, 44 pgs.
"European Application Serial No. 17767365.4, Communication Pursuant to Article 94(3) EPC dated May 9, 2022", 7 pgs.
Ian's, Shoelace Site, "Straight Bar Lacing", archived by The Wayback Machine, [Online] Retrieved from the internet: <https://www.fieggen.com/shoelace/straightbarlacing.htm>, (2015), 6 pgs.
"U.S. Appl. No. 16/279,064, Non Final Office Action dated Aug. 2, 2021", 18 pgs.
"U.S. Appl. No. 16/279,064, Examiner Interview Summary dated Sep. 13, 2021", 3 pgs.
"Chinese Application Serial No. 202011299277.0, Office Action dated Sep. 1, 2021", With English translation, 16 pgs.
"U.S. Appl. No. 16/279,064, Final Office Action dated Mar. 22, 2021", 14 pgs.
"U.S. Appl. No. 16/279,064, Response filed May 24, 2021 to Final Office Action dated Mar. 22, 2021", 11 pgs.
"U.S. Appl. No. 16/279,064, Advisory Action dated Jun. 1, 2021", 3 pgs.
"International Application Serial No. PCT US2017 022366, International Search Report dated Jun. 20, 2017", 4 pgs.
"International Application Serial No. PCT US2017 022366, Written Opinion dated Jun. 20, 2017", 6 pgs.
"U.S. Appl. No. 15/070,173, Non Final Office Action dated Jun. 29, 2018", 32 pgs.
"U.S. Appl. No. 15/070,173, Examiner Interview Summary dated Sep. 10, 2018", 2 pgs.
"International Application Serial No. PCT US2017 022366, International Preliminary Report on Patentability dated Sep. 27, 2018", 8 pgs.
"U.S. Appl. No. 15/070,173, Response filed Oct. 1, 2018 to Non Final Office Action dated Jun. 29, 2018", 11 pgs.
"U.S. Appl. No. 15/070,173, Notice of Allowance dated Nov. 14, 2018", 14 pgs.
"U.S. Appl. No. 16/279,064, Preliminary Amendment filed May 8, 2019", 7 pgs.
"European Application Serial No. 17767365.4, Response filed Apr. 26, 2019 to Communication Pursuant to Rules 161 and 162 dated Nov. 2, 2018", 22 pgs.
"Chinese Application Serial No. 201780030242.7, Voluntary Amendment filed Jul. 4, 2019", w English claims, 23 pgs.
"Chinese Application Serial No. 201780030242.7, Office Action dated Sep. 18, 2019", w English translation, summary available in agent letter, 12 pgs.
"U.S. Appl. No. 16/279,064, Restriction Requirement dated Feb. 13, 2020", 8 pgs.

(56) References Cited

OTHER PUBLICATIONS

"European Application Serial No. 17767365.4, Extended European Search Report dated Mar. 9, 2020", 9 pgs.
"Chinese Application Serial No. 201780030242.7, Response filed Feb. 2, 2020 to Office Action dated Sep. 18, 2019", w English claims, 16 pgs.
"Chinese Application Serial No. 201780030242.7, Office Action dated Apr. 8, 2020", w English Translation, 10 pgs.
"U.S. Appl. No. 16/279,064, Response filed Jun. 11, 2020 to Restriction Requirement dated Feb. 13, 2020", 8 pgs.
"Chinese Application Serial No. 201780030242.7, Response filed Jun. 8, 2020 to Office Action dated Apr. 8, 2020", w English claims, 14 pgs.
"European Application Serial No. 17767365.4, Response filed Jun. 25, 2020 to Extended European Search Report dated Mar. 9, 2020", 25 pgs.
"U.S. Appl. No. 16/279,064, Non Final Office Action dated Jul. 22, 2020", 16 pgs.
"U.S. Appl. No. 16/279,064, Examiner Interview Summary dated Sep. 21, 2020", 3 pgs.
"U.S. Appl. No. 16/279,064, Response filed Dec. 17, 2020 to Non Final Office Action dated Jul. 22, 2020", 7 pgs.
Fieggen, Ian, "Double Lacing", [Online]. Retrieved from the Internet: https: www.fieggen.com shoelacedoublelacing.htm, (Apr. 10, 2006).
"Chinese Application Serial No. 202011299277.0, Office Action dated Oct. 12, 2022", w/o English Translation, 4 pgs.
"U.S. Appl. No. 17/083,475, Response filed Jun. 28, 2022 to Restriction Requirement dated May 4, 2022", 7 pgs.
"U.S. Appl. No. 17/083,492, Response filed Jun. 28, 2022 to Restriction Requirement dated May 4, 2022", 7 pgs.
"U.S. Appl. No. 17/083,475, Non Final Office Action dated Jul. 19, 2022", 20 pgs.
"Hiking Biking Lacing", Ian's Shoelace Site, The Wayback Machine, https: web.archive.org web 20140225031759 https: www.fieggen.com shoelace hikingbikinglacing.htm, (2014), 5 pgs.
"U.S. Appl. No. 17/083,492, Non Final Office Action dated Jul. 19, 2022", 21 pgs.
"U.S. Appl. No. 17/083,475, Examiner Interview Summary dated Aug. 26, 2022", 3 pgs.
"U.S. Appl. No. 17/083,492, Examiner Interview Summary dated Aug. 26, 2022", 3 pgs.
"Chinese Application Serial No. 202011299277.0, Office Action dated Oct. 12, 2022", With English translation, 10 pgs.
"Chinese Application Serial No. 202011299277.0, Response filed Sep. 9, 2022 to Office Action dated Apr. 24, 2022", w English Claims, 42 pgs.
"U.S. Appl. No. 17/083,475, Response filed Dec. 19, 2022 to Non Final Office Action dated Jul. 19, 2022", 8 pgs.
"U.S. Appl. No. 17/083,492, Response filed Dec. 19, 2022 to Non Final Office Action dated Jul. 19, 2022", 8 pgs.
"European Application Serial No. 17767365.4, Response filed Nov. 15, 2022 to Communication Pursuant to Article 94(3) EPC dated May 9, 2022", 47 pgs.
"Chinese Application Serial No. 202011299277.0, Response filed Feb. 27, 2023 to Office Action dated Oct. 12, 2022", w English claims, 38 pgs.
"Chinese Application Serial No. 202011299277.0, Decision of Rejection dated Mar. 12, 2023", With English machine translation, 12 pgs.
"U.S. Appl. No. 17/083,475, Final Office Action dated Apr. 5, 2023", 15 pgs.
"U.S. Appl. No. 17/083,492, Final Office Action dated Apr. 5, 2023", 15 pgs.
"U.S. Appl. No. 17/083,475, Response filed May 31, 2023 to Final Office Action dated Apr. 5, 2023", 8 pgs.
"U.S. Appl. No. 17/083,492, Response filed May 31, 2023 to Final Office Action dated Apr. 5, 2023", 8 pgs.
"U.S. Appl. No. 17/083,475, Advisory Action dated Jun. 9, 2023", 3 pgs.
"U.S. Appl. No. 17/083,492, Advisory Action dated Jun. 9, 2023", 3 pgs.
"Chinese Application Serial No. 202011299277.0, Response filed Jun. 12, 2023 to Decision of Rejection dated Mar. 12, 2023", w English claims, 4 pgs.
"U.S. Appl. No. 17/083,475, Response filed Aug. 4, 2023 to Advisory Action dated Jun. 9, 2023 and Final Office Action dated Apr. 5, 2023", 8 pgs.
"U.S. Appl. No. 17/083,492, Response filed Aug. 4, 2023 to Advisory Action dated Jun. 9, 2023 and Final Office Action dated Apr. 5, 2023", 8 pgs.
"U.S. Appl. No. 17/083,475, Non Final Office Action dated Sep. 13, 2023", 15 pgs.
"U.S. Appl. No. 17/083,492, Non Final Office Action dated Sep. 13, 2023", 13 pgs.
"U.S. Appl. No. 17/083,475, Response filed Dec. 13, 2023 to Non Final Office Action dated Sep. 13, 2023", 7 pgs.
"U.S. Appl. No. 17/083,492, Response filed Dec. 13, 2023 to Non Final Office Action dated Sep. 13, 2023", 7 pgs.
"U.S. Appl. No. 17/083,475, Final Office Action mailed Mar. 19, 2024", 18 pgs.
"U.S. Appl. No. 17 083,492, Final Office Action mailed Mar. 19, 2024", 17 pgs.

* cited by examiner

LACE ROUTING PATTERN OF A LACING SYSTEM FOR AN ARTICLE OF FOOTWEAR

BACKGROUND

The present embodiments relate generally to articles of footwear including lacing systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

SUMMARY

In one aspect, the invention provides a lacing system for an article of footwear with a tensioning assembly. The lacing system can include a lace. The lace includes a first lace segment and a second lace segment. The first lace segment has a first end and a second end. The first end can be attached to an upper of the article of footwear on one of a medial side and a lateral side of the upper. The second end can be connected to the tensioning assembly. The second lace segment has a first end and a second end. The first end can be attached to the upper of the article of footwear on one of the medial side and the lateral side of the upper. The second end can be connected to the tensioning assembly. The lacing system can also include a lacing area extending from a throat opening of the article of footwear in a longitudinal direction towards an area proximate to a forefoot region of the article of footwear. The lacing area extends between a medial edge on the medial side of the upper and a lateral edge on the lateral side of the upper. The first lace segment extends between the medial edge and the lateral edge of the lacing area according to a first routing pattern. The second lace segment extends between the medial edge and the lateral edge of the lacing area according to a second routing pattern. A total closure distance between the medial edge and the lateral edge of the lacing area according to the first routing pattern is approximately equal to a total closure distance between the medial edge and the lateral edge of the lacing area according to the second routing pattern.

In another aspect, the invention provides an article of footwear. The article of footwear includes an upper with a lacing area extending from a throat opening of the article of footwear in a longitudinal direction towards an area proximate to a forefoot region of the article of footwear. The lacing area extends between a medial edge on a medial side of the upper and a lateral edge on a lateral side of the upper. The article of footwear can also include a tensioning assembly for adjusting tension of the lacing area of the upper. The article of footwear can also include a lace. The lace includes a first lace segment and a second lace segment. The first lace segment extends between the medial edge and the lateral edge of the lacing area according to a first routing pattern. The second lace segment extends between the medial edge and the lateral edge of the lacing area according to a second routing pattern. A total closure distance between the medial edge and the lateral edge of the lacing area according to the first routing pattern is approximately equal to a total closure distance between the medial edge and the lateral edge of the lacing area according to the second routing pattern.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
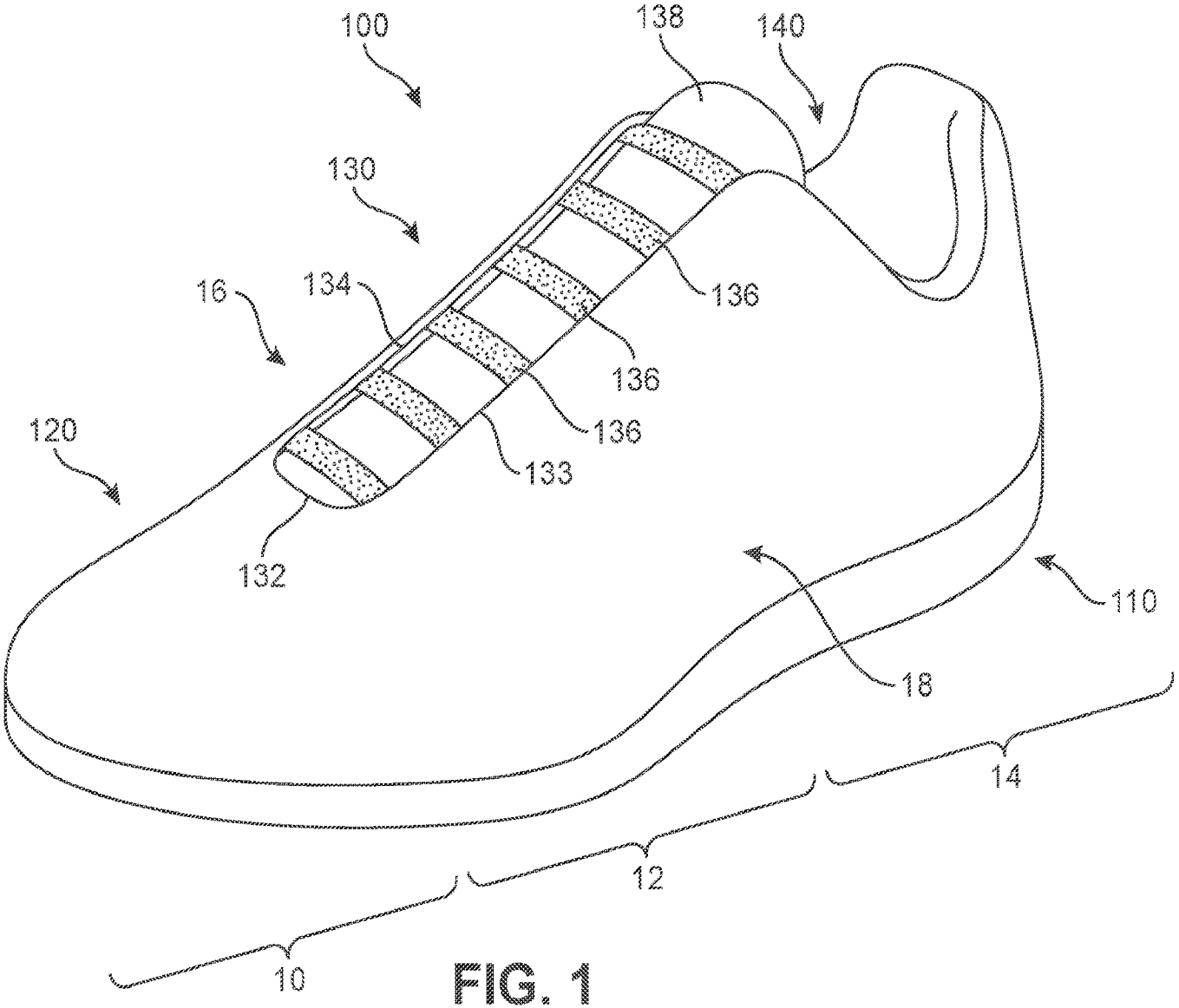
FIG. 1 is a schematic isometric view of an exemplary embodiment of an article of footwear including a lacing system.

FIG. 1 illustrates a schematic isometric view of an exemplary embodiment of article of footwear 100 that is configured with a tensioning system 300 for adjusting the tension of a lacing system 130. In the current embodiment, article of footwear 100, also referred to hereafter simply as article 100, is shown in the form of an athletic shoe. However, in other embodiments, lacing system 130 and/or tensioning system 300 may be used with any other kind of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear. As discussed in further detail below, a tensioning system may not be limited to footwear and in other embodiments a tensioning system could be used with various kinds of apparel, including clothing, sportswear, sporting equipment and other kinds of apparel. In still other embodiments, a tensioning system may be used with braces, such as medical braces.

Figure 2:
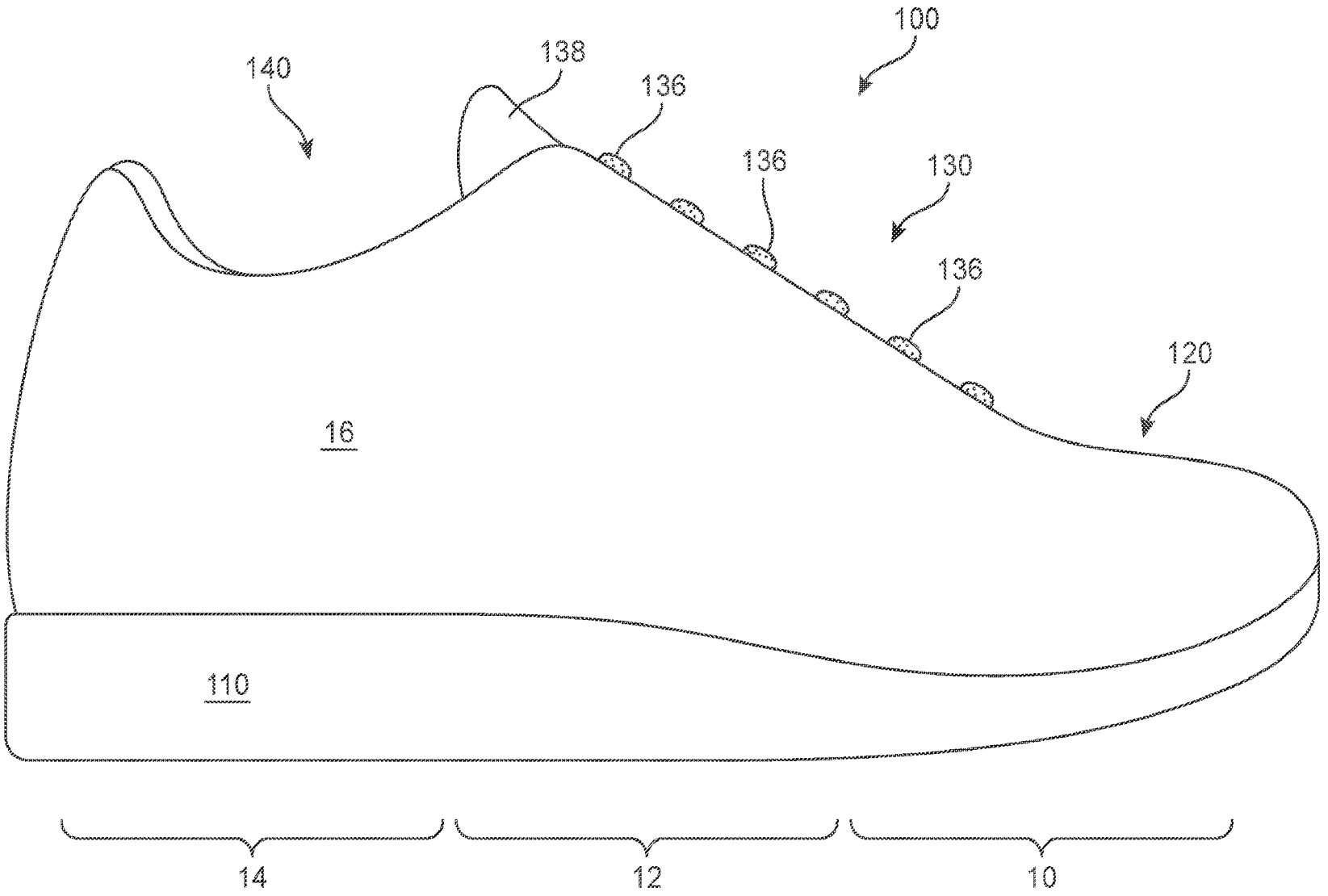
FIG. 2 is a schematic medial side view of the exemplary embodiment of an article of footwear including a lacing system.

For reference purposes, article 100 may be divided into three general regions: a forefoot region 10, a midfoot region 12, and a heel region 14, as shown in FIGS. 1 and 2. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a medial side 16 and a lateral side 18, which extend through each of forefoot region 10, midfoot region 12, and heel region 14 and correspond with opposite sides of article 100. More particularly, medial side 16 corresponds with an inside area of the foot (i.e., the surface that faces toward the other foot), and lateral side 18 corresponds with an outside area of the foot (i.e., the surface that faces away from the other foot). Forefoot region 10, midfoot region 12, and heel region 14 and medial side 16, lateral side 18 are not intended to demarcate precise areas of article 100. Rather, forefoot region 10, midfoot region 12, and heel region 14, and medial side 16, lateral side 18 are intended to represent general areas of article 100 to aid in the following discussion. In addition to article 100, forefoot region 10, midfoot region 12, and heel region 14 and medial side 16, lateral side 18 may also be applied to a sole structure, an upper, and individual elements thereof.

For consistency and convenience, directional adjectives are also employed throughout this detailed description corresponding to the illustrated embodiments. The term "lateral" or "lateral direction" as used throughout this detailed description and in the claims refers to a direction extending along a width of a component or element. For example, a lateral direction of article 100 may extend between medial side 16 and lateral side 18. Additionally, the term "longitudinal" or "longitudinal direction" as used throughout this detailed description and in the claims refers to a direction extending across a length or breadth of an element or component (such as a sole structure or an upper). In some embodiments, a longitudinal direction of article 100 may extend from forefoot region 10 to heel region 14. It will be understood that each of these directional adjectives may also be applied to individual components of an article of footwear, such as an upper and/or a sole structure. In addition, a vertical direction refers to a direction perpendicular to a horizontal surface defined by the longitudinal direction and the lateral direction. It will be understood that each of these directional adjectives may be applied to various components shown in the embodiments, including article 100, as well as components of a tensioning system 300.

In some embodiments, article of footwear 100 may include a sole structure 110 and an upper 120. Generally, upper 120 may be any type of upper. In particular, upper 120 may have any design, shape, size and/or color. For example, in embodiments where article 100 is a basketball shoe, upper 120 could be a high top upper that is shaped to provide high support on an ankle. In embodiments where article 100 is a running shoe, upper 120 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

In different embodiments, sole structure 110 may include different components. For example, sole structure 110 may include an outsole, a midsole, and/or an insole. In addition, in some cases, sole structure 110 can include one or more cleat members or traction elements that are configured to increase traction with a ground surface.

In an exemplary embodiment, sole structure 110 is secured to upper 120 and extends between the foot and the ground when article 100 is worn. Upper 120 defines an interior void within article 100 for receiving and securing a foot relative to sole structure 110. The void is shaped to accommodate the foot and extends along a lateral side of the foot, along a medial side of the foot, over the foot, around the heel, and under the foot. Upper 120 may also include a collar that is located in at least heel region 14 and forms a throat opening 140. Access to the interior void of upper 120 is provided by throat opening 140. More particularly, the foot may be inserted into upper 120 through throat opening 140, and the foot may be withdrawn from upper 120 through throat opening 140.

In some embodiments, article 100 can include a lacing system 130. Lacing system 130 extends forward along the longitudinal direction from the collar and throat opening 140 in heel region 14 over a lacing area 132 corresponding to an instep of the foot in midfoot region 12 to an area adjacent to forefoot region 10. Lacing area 132 also extends in the lateral direction between a lateral edge 133 and a medial edge 134 on opposite sides of upper 120. Lacing system 130 includes various components configured to secure a foot within upper 120 of article 100 and, in addition to the components illustrated and described herein, may further include additional or optional components conventionally included with footwear uppers.

In this embodiment, lacing system 130 includes a plurality of strap members 136 that extend across portions of lacing area 132. Together with tensioning system 300 (described in detail below), plurality of strap members 136 assist the wearer to modify dimensions of upper 120 to accommodate the proportions of the foot. In the exemplary embodiments, plurality of strap members 136 extend laterally across lacing area 132 between lateral edge 133 and medial edge 134 at various lace positions. As will be further described below, lacing system 130 and tensioning system 300, including strap members 136 and a lace 340, permit the wearer to tighten upper 120 around the foot, and to loosen upper 120 to facilitate entry and removal of the foot from the interior void (i.e., through throat opening 140).

In some embodiments, upper 120 includes a tongue 138 that extends over a foot of a wearer when disposed within article 100 to enhance the comfort of article 100. In this embodiment, tongue 138 extends through lacing area 132 and can move within an opening between opposite lateral edge 133 and medial edge 134 of upper 120. In some cases, tongue 138 can extend between lace 340 and/or strap members 136 to provide cushioning and disperse tension applied by lace 340 or strap members 136 against a top of a foot of a wearer. With this arrangement, tongue 138 can enhance the comfort of article 100.

Some embodiments may include provisions for facilitating the adjustment of an article to a wearer's foot, including tightening and/or loosening the article around the wearer's foot. In some embodiments, these provisions may include a tensioning system. In some embodiments, a tensioning system may further include other components that include, but are not limited to, a tensioning member, lacing guides, a tensioning assembly, a housing unit, a motor, gears, spools or reels, and/or a power source. Such components may assist in securing, adjusting tension, and providing a customized fit to a wearer's foot. These components and how, in various embodiments, they may secure the article to a wearer's foot, adjust tension, and provide a customized fit will be explained further in detail below.

Figure 3:
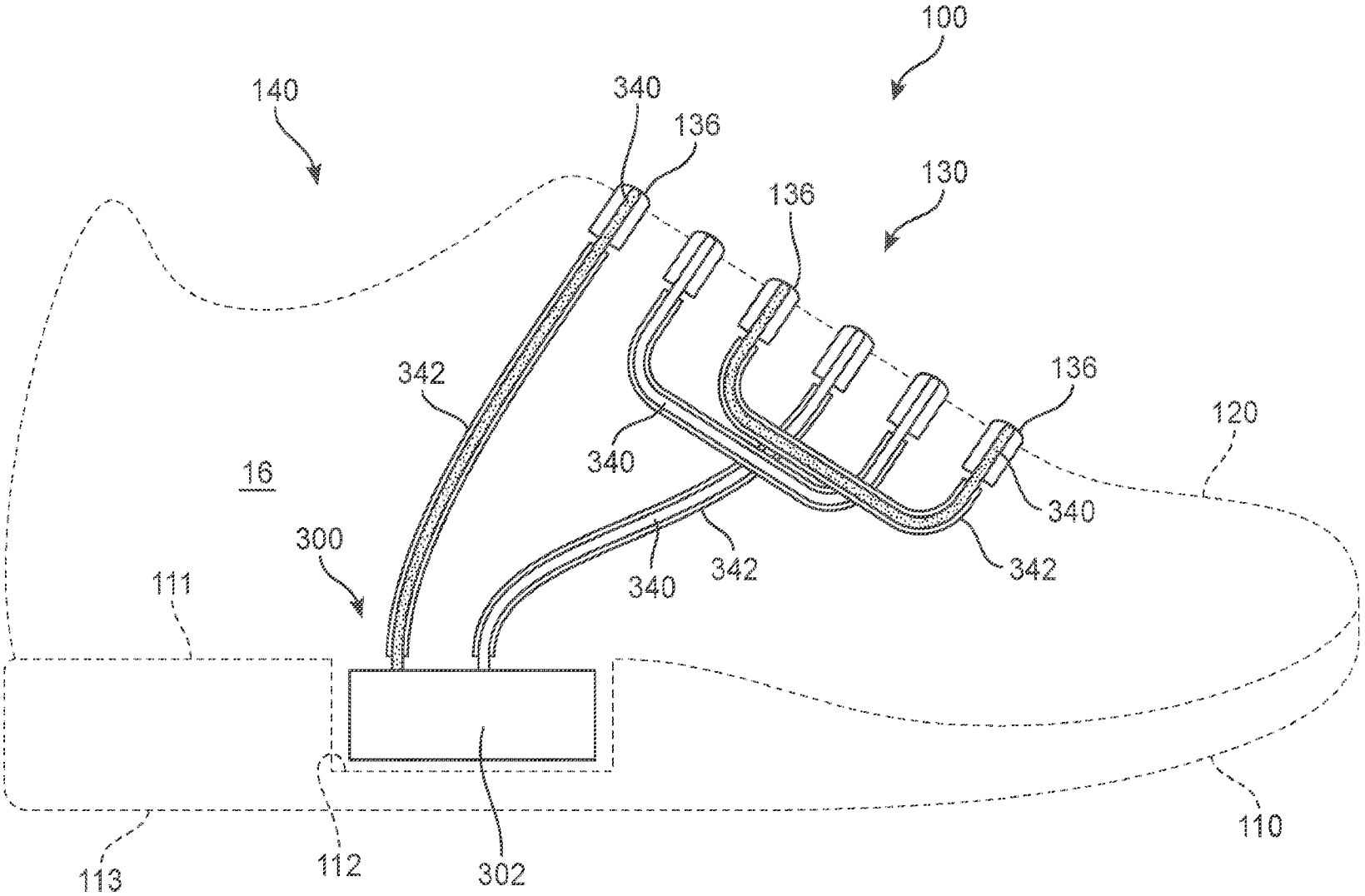
FIG. 3 is a schematic medial side view of an exemplary embodiment of a lacing system with the article of footwear shown in phantom.

Referring now to FIG. 3, article 100 includes an exemplary embodiment of a tensioning system 300. Embodiments of tensioning system 300 may include any suitable tensioning system, including incorporating any of the systems disclosed in one or more of Beers et al., U.S. Patent Application Publication Number 2014/0068838, now U.S. application Ser. No. 14/014,491, filed Aug. 20, 2013, and titled "Motorized Tensioning System"; Beers, U.S. Patent Application Publication Number 2014/0070042, now U.S. application Ser. No. 14/014,555, filed Aug. 20, 2013 and titled "Motorized Tensioning System with Sensors"; and Beers, U.S. Patent Application Publication Number 2014/0082963, now U.S. application Ser. No. 14/032,524, filed Sep. 20, 2013 and titled "Footwear Having Removable Motorized Adjustment System"; which applications are hereby incorporated by reference in their entirety (collectively referred to herein as the "Automatic Lacing cases").

In different embodiments, a tensioning system may include a tensioning member. The term "tensioning member" as used throughout this detailed description and in the claims refers to any component that has a generally elongated shape and high tensile strength. In some cases, a tensioning member could also have a generally low elasticity. Examples of different tensioning members include, but are not limited to: laces, cables, straps and cords. In some cases, tensioning members may be used to fasten and/or tighten an article, including articles of clothing and/or footwear. In other cases, tensioning members may be used to apply tension at a predetermined location for purposes of actuating some components or system.

In an exemplary embodiment, tensioning system 300 includes a tensioning member in the form of a lace 340. Lace 340 is configured to modify the dimensions of the interior void of upper 120 and to thereby tighten (or loosen) upper 120 around a wearer's foot. In one embodiment, lace 340 may be configured to move plurality of strap members 136 of lacing system 130 so as to bring opposite lateral edge 133 and medial edge 134 of lacing area 132 closer together to tighten upper 120. Similarly, lace 340 may also be configured to move plurality of strap members 136 in the opposite direction to move lateral edge 133 and medial edge 134 further apart to loosen upper 120. With this arrangement, lace 340 may assist with adjusting tension and/or fit of article 100.

In some embodiments, lace 340 may be connected or joined to strap members 136 so that movement of lace 340 is communicated to plurality of strap members 136. For example, lace 340 may be bonded, stitched, fused, or attached using adhesives or other suitable mechanisms to attach portions of lace 340 extending across lacing area 132 to each strap member of plurality of strap members 136. With this arrangement, when tension is applied to lace 340 via tensioning system 300 to tighten or loosen lacing system 130, lace 340 can move strap members 136 between an open or closed position.

In some embodiments, lace 340 may be configured to pass through various lacing guides 342 that route lace 340 across portions of upper 120. Lacing guides 342 can be configured to route lace 340, including segments of lace 340, according to different lace routing patterns, as will be described in more detail below. In some cases, ends of lacing guides 340 may terminate adjacent to lateral edge 133 and medial edge 134 of lacing area 132. In some cases, lacing guides 342 may provide a similar function to traditional eyelets on uppers. In particular, as lace 340 is pulled or tensioned, lacing area 132 may generally constrict so that upper 120 is tightened around a foot. In one embodiment, lacing guides 342 may be routed or located between layers of the material forming upper 120, including any interior layers or linings.

In some embodiments, lacing guides 342 may be used to arrange lace 340 in a predetermined configuration or lace routing pattern on upper 120 of article 100. Referring to FIGS. 3-6, segments of lace 340 are arranged in exemplary lace routing patterns on upper 120 to provide approximately equal total closure distances for the configuration of each lace segment. In other embodiments, lace 340 may be arranged, via lacing guides 342, in different routing patterns or configurations.

In some embodiments, tensioning system 300 includes a tensioning assembly 302 that is configured to adjust the tension of components of lacing system 130, including lace 340 and/or strap members 136, to secure, adjust, and modify the fit of article 100 around a wearer's foot. Tensioning assembly 302 may be any suitable device for adjusting tension of a tensioning member, such as a lace or strap, and can include any of the devices or mechanisms described in the Automatic Lacing cases described above. In an exemplary embodiment, tensioning assembly 302 is configured to wind and/or unwind lace 340 to adjust tension within tensioning system 300. In some cases, tensioning assembly 302 can include a motor or other device that is connected to lace 340 and is controllable to wind and/or unwind lace 340. With this configuration, tensioning assembly 302 is interconnected with lace 340 to permit lace 340 to adjust the fit of upper 120 by opening or closing lacing system 130 when lace 340 is wound or unwound by tensioning assembly 302.

Some components of tensioning assembly 302 can be disposed within a housing unit. In some embodiments, a housing unit can be shaped so as to optimize the arrangement of components of tensioning assembly 302. In one embodiment, tensioning assembly 302 can include a housing unit that has an approximately rectangular shape. However, it should be understood that the shape and configuration of the housing unit may be modified in accordance with the type and configuration of tensioning assembly used within tensioning system 300.

In some embodiments, tensioning assembly 302 of tensioning system 300 may be located within a cavity 112 insole structure 110. Sole structure 110 can include an upper surface 111 that is disposed adjacent to upper 120 on a top of sole structure 110. Upper surface 111 may be directly or indirectly attached or joined to upper 120 or a component of upper 120 to secure sole structure 110 and upper 120 together. Sole structure 110 may also include a lower surface or ground-engaging surface 113 that is disposed opposite upper surface 111. Ground-engaging surface 113 may be an outsole or other component of sole structure 110 that is configured to be in contact with a ground surface when article 100 is worn.

In an exemplary embodiment, cavity 112 is an opening in sole structure 110 extending from upper surface 111 towards lower surface 113. Tensioning assembly 302 of tensioning system 300 may be inserted within cavity 112 from the top of sole structure 110. In an exemplary embodiment, cavity 112 has an approximately rectangular shape that corresponds with the rectangular shape of the housing unit of tensioning assembly 302. In addition, cavity 112 may be of a similar size and dimension as tensioning assembly 302 so that tensioning assembly 302 conformably fits within cavity 112. With this arrangement, tensioning assembly 302 and related components may be protected from contact with a ground surface by lower surface 113 when article 100 is worn.

Figure 4:
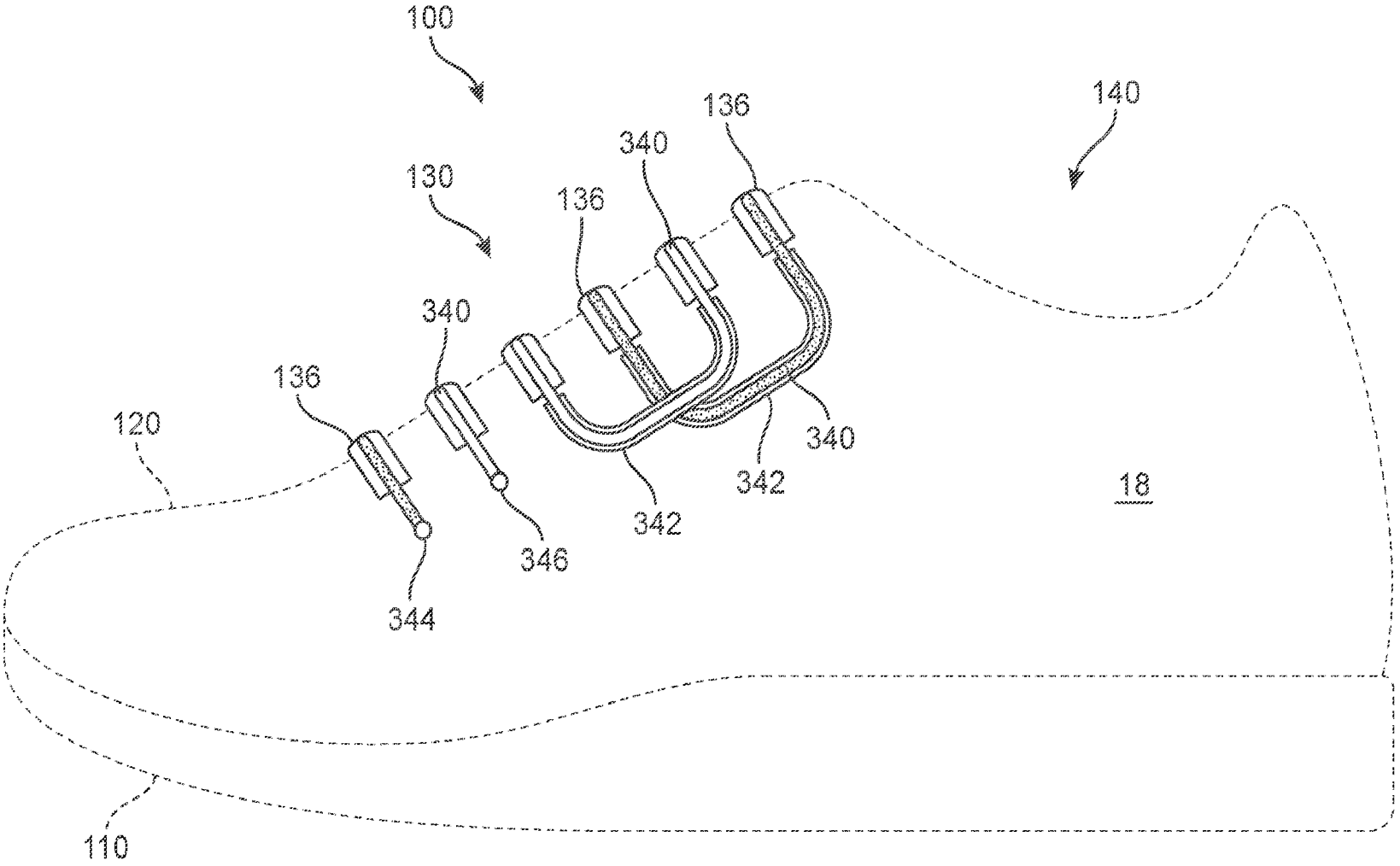
FIG. 4 is a schematic lateral side view of an exemplary embodiment of a lacing system with the article of footwear shown in phantom.

In addition, to facilitate lace 340 being able to tighten and loosen tensioning system 300, ends of lace 340 are anchored to upper 120 at different locations. As seen in FIG. 4, a first anchor 344 secures one end of lace 340 to upper 120 near or adjacent to forefoot region 10 of upper 120 and a second anchor 346 secures the opposite end of lace 340 to upper 120 at a location that is located rearward in the longitudinal direction from first anchor 344 towards throat opening 140. First anchor 344 and second anchor 346 may be attached or joined to upper 120 may any suitable mechanism, including, but not limited to, knotting, bonding, sewing, adhesives, or other forms of attachment. By securing lace 340 to upper 120 at first anchor 344 and second anchor 346, tension can applied by tensioning assembly 302 to lace 340 to secure, adjust, and modify the fit of article 100 around a wearer's foot.

Figure 5:
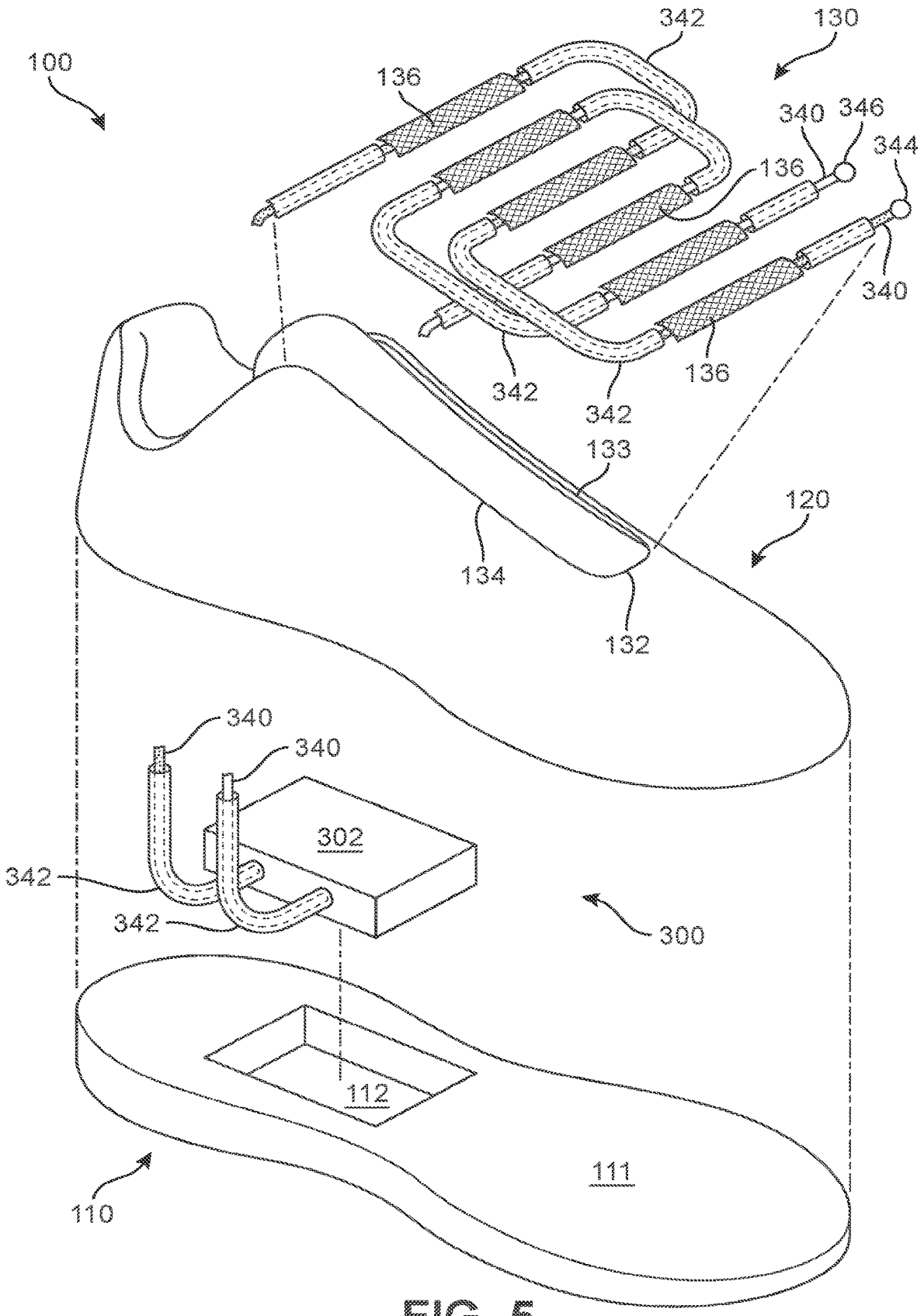
FIG. 5 is a schematic exploded view of the exemplary embodiment of an article of footwear including a lacing system.

Referring now to FIG. 5, an exploded view of article 100, including sole structure 110, upper 120, lacing system 130, and tensioning system 300 are illustrated. In this embodiment, the configuration of lace 340 through lacing guides 342 can be seen according to two lace routing patterns extending across lacing area 132 at various locations of upper 120 between medial edge 134 on medial side 16 and lateral edge 133 on lateral side 18.

In this embodiment, tensioning system 300 includes tensioning assembly 302 and lace 340. In some cases, tensioning assembly 302 can include a reel member (illustrated in FIGS. 11-12) that is mechanically coupled to a motor (not shown). In some embodiments, the motor could include an electric motor. However, in other embodiments, the motor could comprise any kind of non-electric motor known in the art. Examples of different motors that can be used include, but are not limited to: DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art.

Additionally, the motor can further include gears, crankshafts, or other assemblies that can be used to drive one or more components of tensioning assembly 302. For example, one or more gears may be mechanically coupled to a reel member and may be driven by a crankshaft of the motor to be rotated in opposite directions around a central axis and thereby wind or unwind lace 340.

For purposes of reference, the following detailed description uses the terms "first rotational direction" and "second rotational direction" in describing the rotational directions of one or more components about a central axis. For purposes of convenience, the first rotational direction and the second rotational direction refer to rotational directions about the central axis of a shaft of a reel member and are generally opposite rotational directions. The first rotational direction may refer to the counterclockwise rotation of a component about the central axis, when viewing the component from the vantage point of a first end of the shaft. The second rotational direction may be then be characterized by the clockwise rotation of a component about the central axis, when viewing the component from the same vantage point.

In some embodiments, tensioning assembly 302 may also include provisions for powering the motor, including a power source that may include a battery and/or control unit configured to power and control tensioning assembly 302. The power source may be any suitable battery of one or more types of battery technologies that could be used to power the motor and tensioning system 302. One possibly battery technology that could be used is a lithium polymer battery. The battery (or batteries) could be rechargeable or replaceable units packaged as flat, cylindrical, or coin shaped. In addition, batteries could be single cell or cells in series or parallel. Other suitable batteries and/or power sources may be used to provide power to tensioning assembly 302.

In an exemplary embodiment, the housing unit of tensioning assembly 302 includes openings that permit lace 340 to enter into tensioning assembly 302 and engage with the reel member. As shown in FIG. 5, lace 340 includes two portions or segments that extend out from tensioning assembly 302. As will be further described below, each portion or segment of lace 340 may be arranged according to a specific lace routing pattern across portions of lacing area 132 of lacing system 130 so that each lace segment encompasses a substantially similar total closure distance that is equal to the take up distance of the lace segments when lace 340 is wound within tensioning assembly 302 in a tightened condition.

Figure 6:
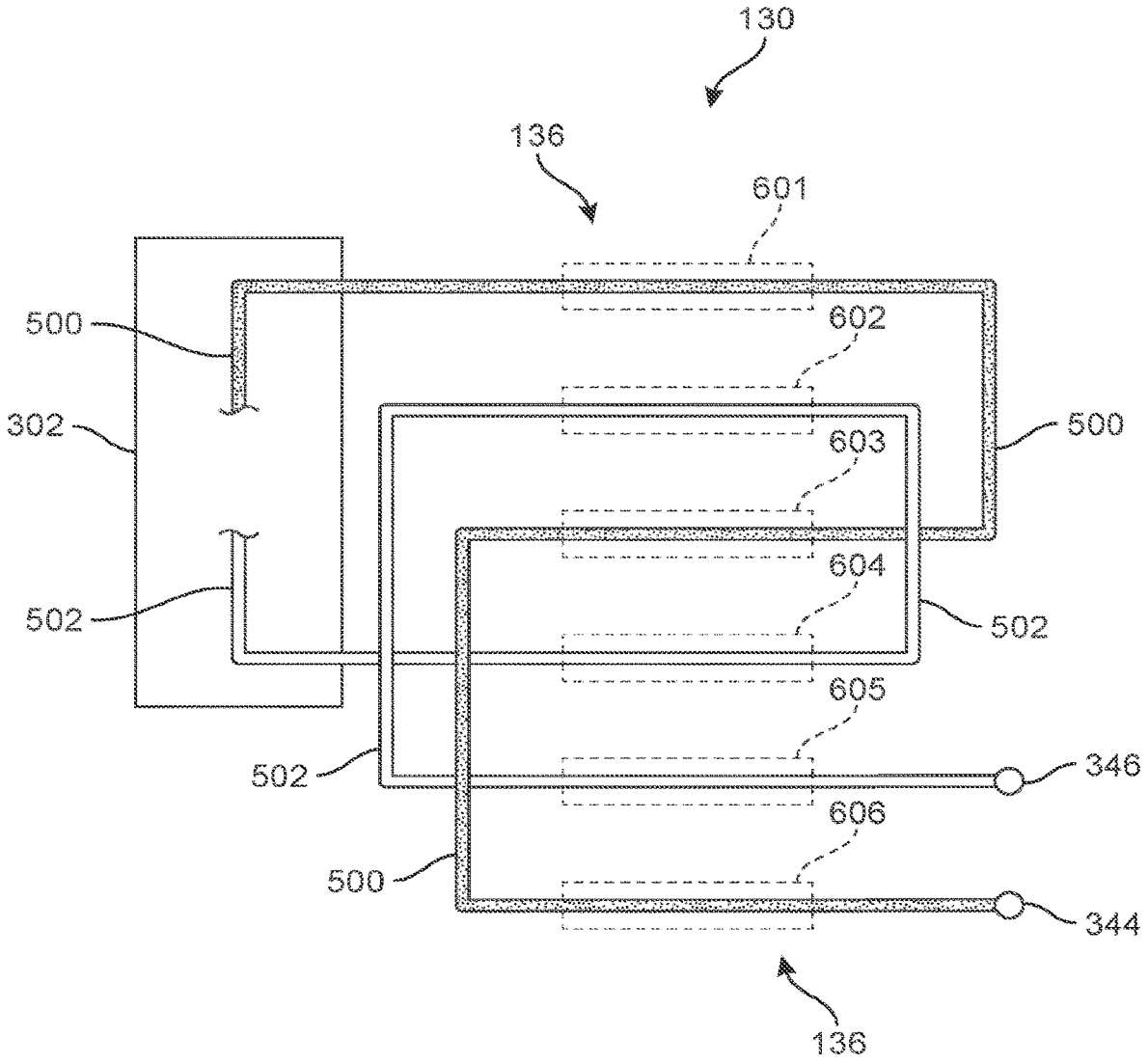
FIG. 6 is a representative diagram of lace routing patterns of a lacing system for an article of footwear.

Referring now to FIG. 6, an exemplary embodiment of lace routing patterns for lace 340 of lacing system 130 is illustrated. In this embodiment, lace 340 includes a first lace segment 500 and a second lace segment 502. First lace segment 500 and second lace segment 502 are portions of lace 340 that extend from tensioning assembly 302. Each of the lace segments of lace 340 are interconnected with to tensioning assembly 302 at one end and attached or connected to upper 120 at the opposite end. For example, a first end of first lace segment 500 is attached to upper 120 at first anchor 344 and an opposite second end of first lace segment 500 is interconnected with a reel member of tensioning assembly 302. A first end of second lace segment 502 is attached to upper 120 at second anchor 346 and an opposite second end of second lace segment 502 is interconnected with the reel member of tensioning assembly 302. In some embodiments, first lace segment 500 and second lace segment 502 may be disposed on opposite sides of a flange of a reel member within tensioning system 302. The flange of the reel member can include an aperture through which lace 340 extends to interconnect lace 340 with tensioning system 302.

In this embodiment, a first routing pattern is associated with first lace segment 500 and a second routing pattern is associated with second lace segment 502. That is, first lace segment 500 is configured to repeatedly extend across lacing area 132 between medial edge 134 on medial side 16 of upper 120 and lateral edge 133 on lateral side 18 of upper 120 according to the first routing pattern. Second lace segment 502 is configured to repeatedly extend across lacing area 132 between medial edge 134 on medial side 16 of upper 120 and lateral edge 133 on lateral side 18 of upper 120 according to the second routing pattern.

For the purposes of defining each location where first lace segment 500 and/or second lace segment 502 crosses over lacing area 132 between medial edge 134 and lateral edge 133, lacing system 130 can include a plurality of lace positions. In an exemplary embodiment, lacing system 130 includes a first lace position 601, a second lace position 602, a third lace position 603, a fourth lace position 604, a fifth lace position 605, and a sixth lace position 606. Each "lace position" represents a location on upper 120 where first lace segment 500 and/or second lace segment 502 crosses between lateral edge 133 and medial edge 134 of lacing area 132. In some cases, each lace position may be associated with a corresponding one strap member of plurality of strap members 136. Providing strap members 136 at each lace position may provide article 100 with a similar visual appearance as a conventional or traditional shoe upper with conventional tied laces.

In an exemplary embodiment, first lace position 601 is disposed adjacent to throat opening 140 of article 100, second lace position 602 is disposed forward of first lace position 601 in the longitudinal direction, third lace position 603 disposed forward of second lace position 602 in the longitudinal direction, fourth lace position 604 disposed forward of third lace position 603 in the longitudinal direction, fifth lace position 605 is disposed forward of fourth lace position 604 in the longitudinal direction, and sixth lace position 606 is disposed forward of fifth lace position 605 in the longitudinal direction. Accordingly, first lace position 601, second lace position 602, third lace position 603, fourth lace position 604, fifth lace position 605, and sixth lace position 606 extend in sequential order from throat opening 140 towards forefoot region 10 at the front or toe end of article 100.

In some embodiments, the distribution of tension throughout upper 120 provided by tensioning system 300 to lacing system 130 can be determined by the lace routing pattern of lace 340, or segments of lace 340, across lacing area 132. In this embodiment, the first routing pattern of first lace segment 500 extends between medial edge 134 and lateral edge 133 of lacing area 132 through first lace position 601, third lace position 603, and sixth lace position 606. The second routing pattern of second lace segment 502 extends between medial edge 134 and lateral edge 133 of lacing area 132 through second lace position 602, fourth lace position 604, and fifth lace position 605. In different embodiments, the lace routing patterns of segments of lace 340, or segments of lace 340, may be configured according to specific arrangements to alter or change the behavior or characteristics of lacing system 130 and/or tensioning system 300.

Referring to FIGS. 3 through 6, the first routing pattern of first lace segment 500 extends from tensioning assembly 302 through first lace position 601 and across lacing area 132 from medial edge 134 to lateral edge 133. From first lace position 601, the first routing pattern of first lace segment 500 extends forward in the longitudinal direction from first lace position 601 to third lace position 603 on lateral side 18 of upper 120. At third lace position 603, the first routing pattern of first lace segment 500 extends across lacing area 132 from lateral edge 133 to medial edge 134. From third lace position 603 on medial side 16 of upper 120, the first routing pattern of first lace segment 500 extends forward in the longitudinal direction to sixth lace position 606. The first routing pattern of first lace segment 500 extends back across lacing area 132 from medial edge 134 to lateral edge 133. Finally, the first end of first lace segment 500 is secured to upper 120 on lateral side 18 at first anchor 344.

The second routing pattern of second lace segment 502 extends from tensioning assembly 302 through fourth lace position 604 and across lacing area 132 from medial edge 134 to lateral edge 133. From fourth lace position 604, the second routing pattern of second lace segment 502 extends rearward in the longitudinal direction from fourth lace position 604 to second lace position 602 on lateral side 18 of upper 120. At second lace position 602, the second routing pattern of second lace segment 502 extends across lacing area 132 from lateral edge 133 to medial edge 134. From second lace position 602 on medial side 16 of upper 120, the second routing pattern of second lace segment 502 extends forward in the longitudinal direction to fifth lace position 605. The second routing pattern of second lace segment 502 extends back across lacing area 132 from medial edge 134 to lateral edge 133 through fifth lace position 605. Finally, the first end of second lace segment 502 is secured to upper 120 on lateral side 18 at second anchor 346.

As can be seen in FIGS. 3, 4, and 5, lacing guides 342 may include portions that extend over other portions of lacing guides 342 to route first lace segment 500 and/or second lace segment 502 according to the first routing pattern and the second routing pattern. For example, when extending to fifth lace position 605, the second routing pattern of second lace segment 502 can cross over the portion of lacing guides 342 that route second lace segment 502 through fourth lace position 604. As seen in FIG. 3, on medial side 16 of upper 120 and in FIG. 4 on lateral side 18 of upper 120, lacing guides 342 receive first lace segment 500 and second lace segment 502 and are arranged within upper 120 to route first lace segment 500 and second lace segment 502 according to the first routing pattern and the second routing pattern. In other embodiments, lacing guides 342 can be arranged differently to route segments of lace 340 according to a different routing pattern.

In some embodiments, the first routing pattern and the second routing pattern can be selected so that a total closure distance between medial edge 134 and lateral edge 133 of lacing area 132 according to the first routing pattern is approximately equal to a total closure distance between medial edge 134 and lateral edge 133 of lacing area 132 according to the second routing pattern. In addition, a take up distance of first lace segment 500 by tensioning assembly 302 in a tightened condition is approximately equal to a take up distance of second lace segment 502 by tensioning assembly 302 in the tightened condition. With the lace routing patterns according to the present embodiments, the take up distance of first lace segment 500 is approximately equal to the total closure distance between medial edge 134 and lateral edge 133 of lacing area 132 according to the first routing pattern. Similarly, the take up distance of second lace segment 502 is approximately equal to the total closure distance medial edge 134 and lateral edge 133 of lacing area 132 according to the second routing pattern. With this arrangement, tension within upper 120 of article 100 may be approximately uniformly distributed across lacing system 130 by tensioning system 300.

FIGS. 7 through 10 illustrate enlarged views of lacing area 132 of upper 120 with lacing system 130 in various states between a closed position and an opened position. In the present embodiments, the closed position of lacing system 130 may correspond with the tightened condition of tensioning system 300 and can include lace 340, or segments thereof, being wound. Similarly, the open position of lacing system 130 may correspond with the loosened condition of tensioning system 300 and can include lace 340, or segments thereof, being unwound.

Figure 7:
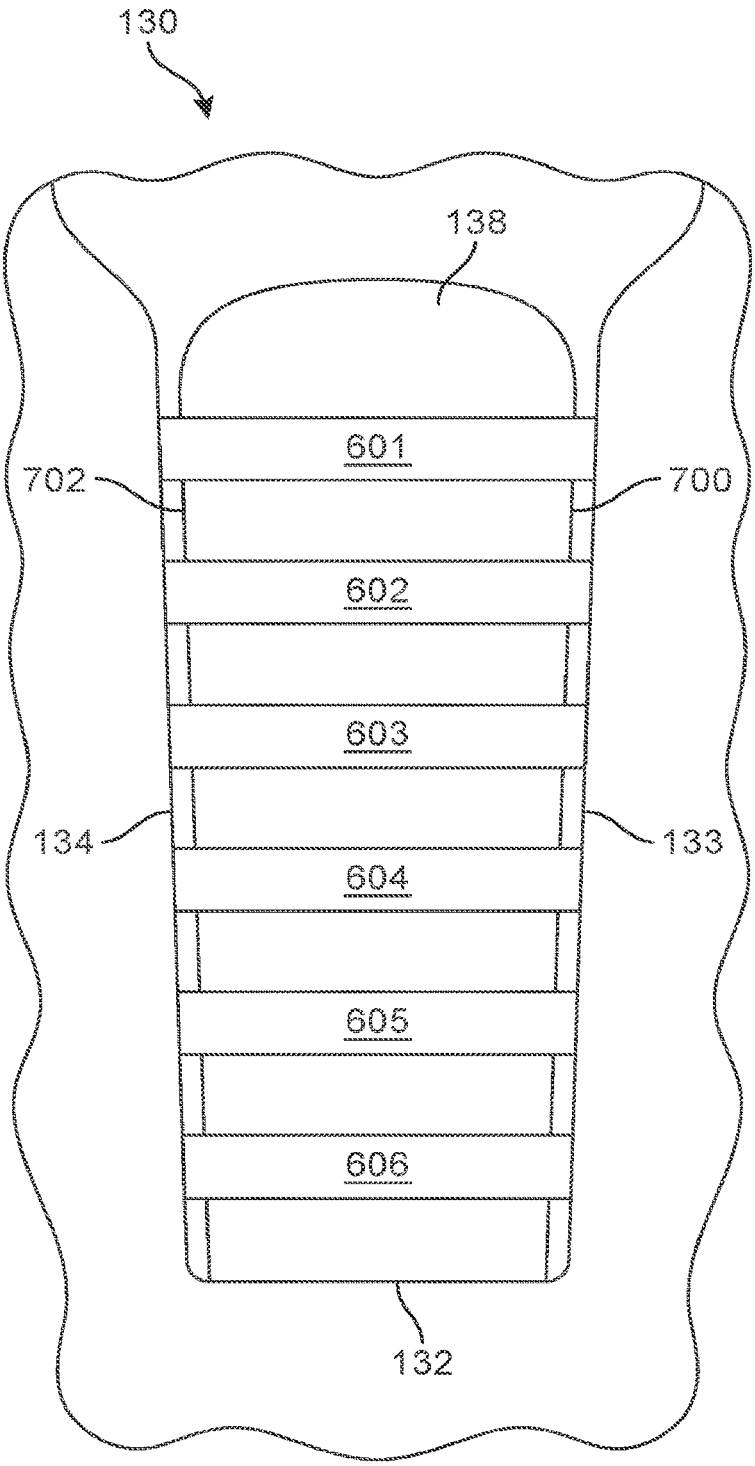
FIG. 7 is a representative enlarged top down view of an exemplary embodiment of a lacing system for an article of footwear.

Referring now to FIG. 7, as described above, lacing system 130 includes lacing area 132 and tongue 138 disposed between medial edge 134 on medial side 16 of upper 120 and lateral edge 133 on lateral side 18 of upper 120. Tongue 138 can include a lateral perimeter edge 700 disposed on lateral side 18 of upper 120 near lateral edge 133 of lacing area 132 and a medial perimeter edge 702 disposed on medial side 16 of upper 120 near medial edge 134 of lacing area 132.

Lacing system 130 can further include a plurality of lace positions, as described with reference to FIG. 6 above. In this embodiment, lacing system 130 includes first lace position 601, second lace position 602, third lace position 603, fourth lace position 604, fifth lace position 605, and sixth lace position 606 extending in sequential order from throat opening 140 towards forefoot region 10 at the front or toe end of article 100. Each of first lace position 601, second lace position 602, third lace position 603, fourth lace position 604, fifth lace position 605, and sixth lace position 606 extends between medial edge 134 and lateral edge 133 of lacing area 132.

Figure 8:
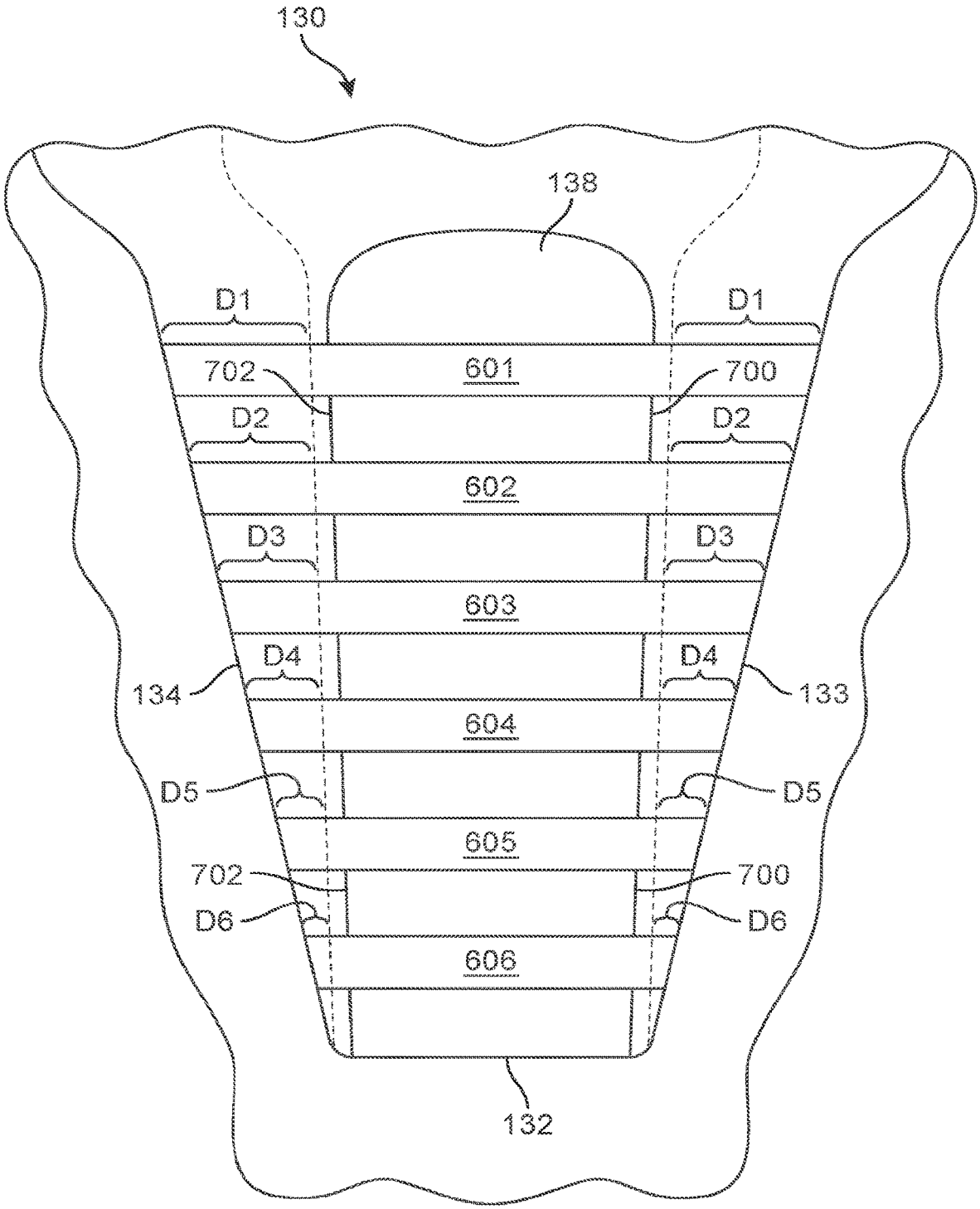
FIG. 8 is a representative enlarged top down view of an exemplary embodiment of a lacing system for an article of footwear in an opened position and illustrating closure distances.

Referring now to FIG. 8, lacing system 130 is shown in an opened position. When lacing system 130 is in the opened position, medial edge 134 and lateral edge 133 are moved farther apart from one another and move a predetermined distance compared with their respective location when lacing system 130 is in the closed position. The predetermined distance that each of medial edge 134 and lateral edge 133 move between their respective locations in the opened position and the closed position can be associated with a closure distance. That is, the closure distance is the distance that each of medial edge 134 and lateral edge 133 travels when transitioning between the opened position and the closed position of lacing system 130 (or, likewise, between the closed position and the opened position).

In this embodiment, lacing system 130 includes closure distances that are associated with each lace position. First lace position 601 can have a first closure distance D1, second lace position 602 can have a second closure distance D2, third lace position 603 can have a third closure distance D3, fourth lace position 604 can have a fourth closure distance D4, fifth lace position 605 can have a fifth closure distance D5, and sixth lace position 606 can have a sixth closure distance D6. In the present embodiments, the closure distances of each of medial edge 134 and lateral edge 133 on both sides of lacing area 132 are approximately equal. For each lace position, the closure distance between medial edge 134 and lateral edge 133 will be twice the closure distance for each lace position. For example, the closure distance between medial edge 134 and lateral edge 133 at first lace position 601 will be double first closure distance D1. That is, medial edge 134 moves first closure distance D1 between the opened and closed positions of lacing system 130 on medial side 16 and lateral edge 133 also moves first closure distance D1 between the opened and closed positions of lacing system 130 on lateral side 18.

The total closure distance between medial edge 134 and lateral edge 133 for each segment of lace 340, i.e., first lace segment 500 and second lace segment 502, can be determined by adding the sum of the closure distances for each lace position that includes a crossing by the first lace segment 500 or the second lace segment 502. The first routing pattern of first lace segment 500 can have a total closure distance that is the sum of the closure distances for each lace position associated with the first routing pattern. Similarly, the second routing pattern of second lace segment 502 can have a total closure distance that is the sum of the closure distances for each lace position associated with the second routing pattern. Additionally, as described above, the first routing pattern and the second routing pattern can be selected so that a total closure distance between medial edge 134 and lateral edge 133 of lacing area 132 according to the first routing pattern is approximately equal to a total closure distance between medial edge 134 and lateral edge 133 of lacing area 132 according to the second routing pattern.

Figure 9:
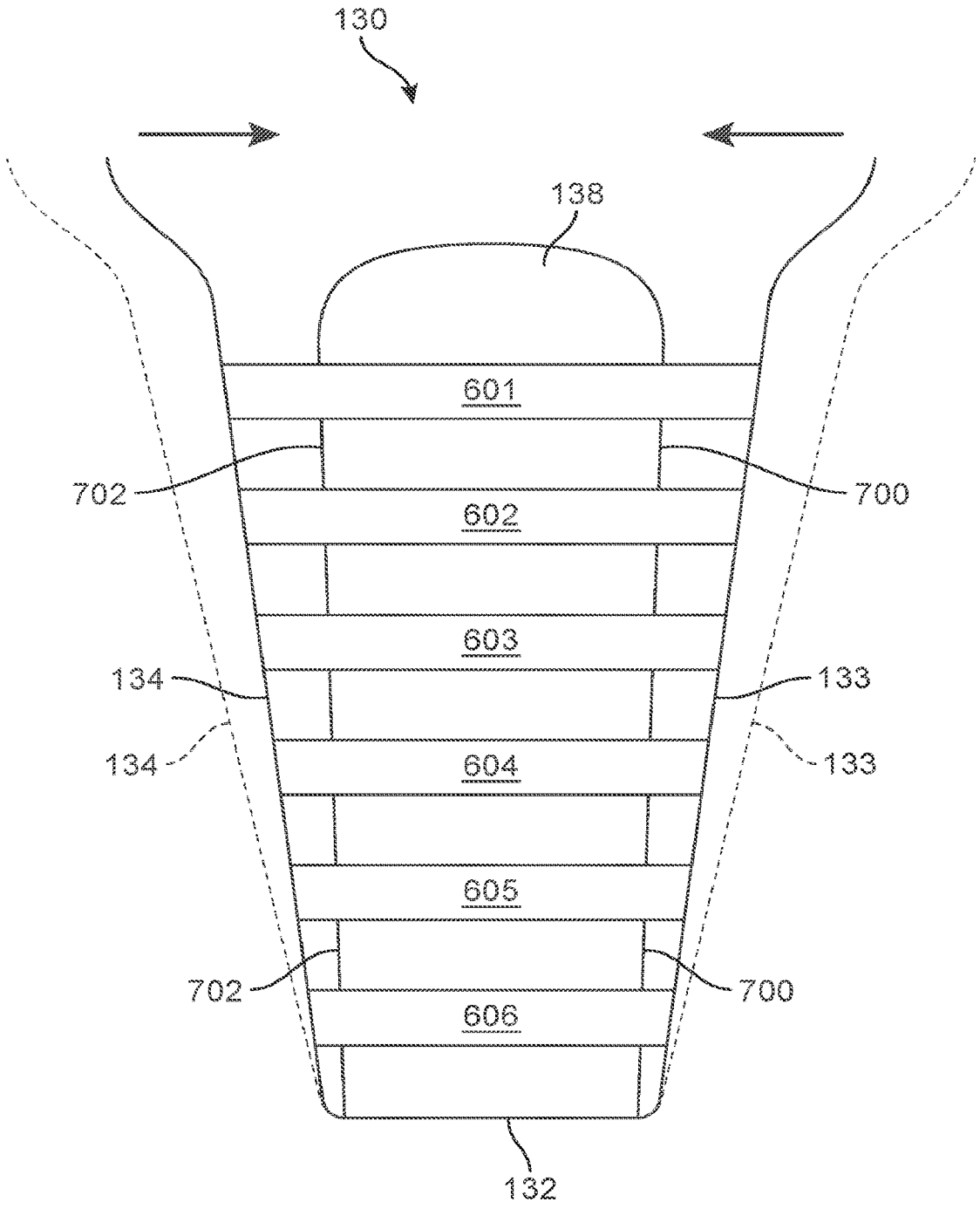
FIG. 9 is a representative enlarged top down view of an exemplary embodiment of a lacing system for an article of footwear in the process of closing.

FIG. 9 illustrates lacing system 130 in a partially closed state. In this embodiment, lacing system 130 is transitioning between the opened position shown in FIG. 8 to a closed position shown in FIG. 10. In an exemplary embodiment, tensioning assembly 302 of tensioning system 300 can be controlled to a tightened condition and configured to wind lace 340 to transition lacing system 130 from the opened position to the closed position. As first lace segment 500 and second lace segment 502 are wound by tensioning assembly 302, each of first lace segment 500 and second lace segment 502 pulls on opposite sides of lacing area 132 to bring medial edge 134 and lateral edge 133 of lacing area 132 closer together. As shown in FIG. 9, medial edge 134 moves towards medial perimeter edge 702 of tongue 138 and opposite lateral edge 133 moves towards lateral perimeter edge 700 of tongue 138. Both of medial edge 134 and lateral edge 133 in the partially closed state of lacing system 130 are displaced relative to their locations when lacing system 130 is in the opened position (shown in phantom).

Figure 10:
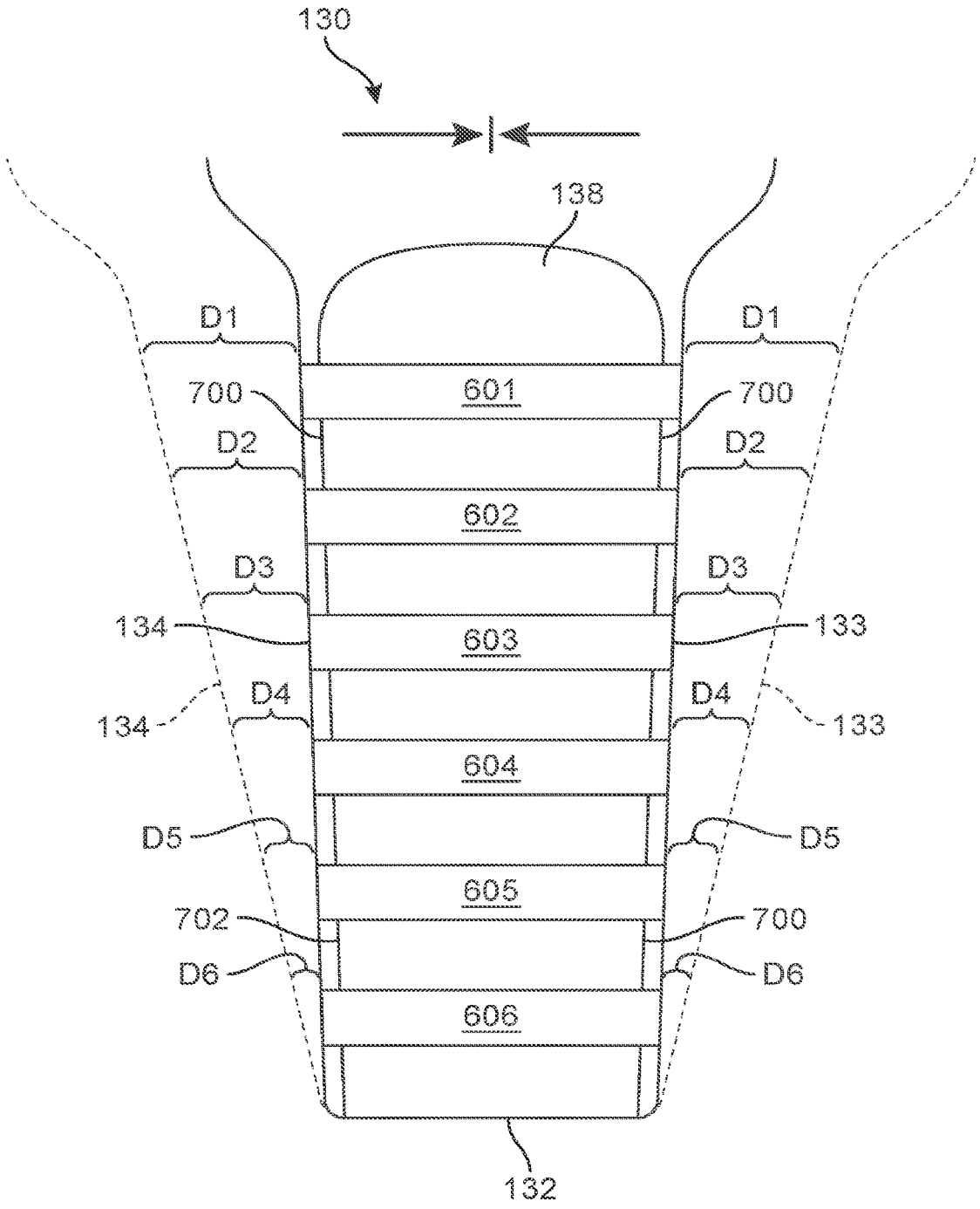
FIG. 10 is a representative enlarged top down view of an exemplary embodiment of a lacing system for an article of footwear in a closed position.

Referring now to FIG. 10, tensioning assembly 302 of tensioning system 300 continues to apply tension to lace 340 until lacing system 130 is in the closed position. In an exemplary embodiment, the amount of each of first lace segment 500 and second lace segment 502 that is wound up by tensioning assembly 302 of tensioning system 300 in the tightened condition to place lacing system 130 in the closed position from the opened positon can be referred to as a take up distance. That is, the take up distance is the amount of each of first lace segment 500 and second lace segment 502 that is wound around a reel member (described below) of tensioning assembly 302 when tensioning system 300 transitions from a loosened condition to a tightened condition to thereby bring medial edge 134 and lateral edge 133 of lacing area 132 from their respective locations in the opened position to their locations in the closed position of lacing system 130.

In an exemplary embodiment, the take up distance of first lace segment 500 by tensioning assembly 302 in a tightened condition is approximately equal to the take up distance of second lace segment 502 by tensioning assembly 302 in the tightened condition. With the lace routing patterns according to the present embodiments, the take up distance of first lace segment 500 is approximately equal to the total closure distance between medial edge 134 and lateral edge 133 of lacing area 132 according to the first routing pattern. Similarly, the take up distance of second lace segment 502 is approximately equal to the total closure distance medial edge 134 and lateral edge 133 of lacing area 132 according to the second routing pattern.

As shown in FIG. 10, the total closure distance between medial edge 134 and lateral edge 133 of lacing area 132 according to the first routing pattern of first lace segment 500 is equal to twice the sum of: first closure distance D1 of first lace position 601, third closure distance D3 of third lace position 603, and sixth closure distance D6 of sixth lace position 606. Similarly, the total closure distance between medial edge 134 and lateral edge 133 of lacing area 132 according to the second routing pattern of second lace segment 502 is equal to twice the sum of: second closure distance D2 of second lace position 602, fourth closure distance D4 of fourth lace position D4, and fifth closure distance D5 of fifth lace position 605. With this arrangement, tension within upper 120 of article 100 may be approximately uniformly distributed across lacing system 130 by tensioning system 300.

Figure 11:
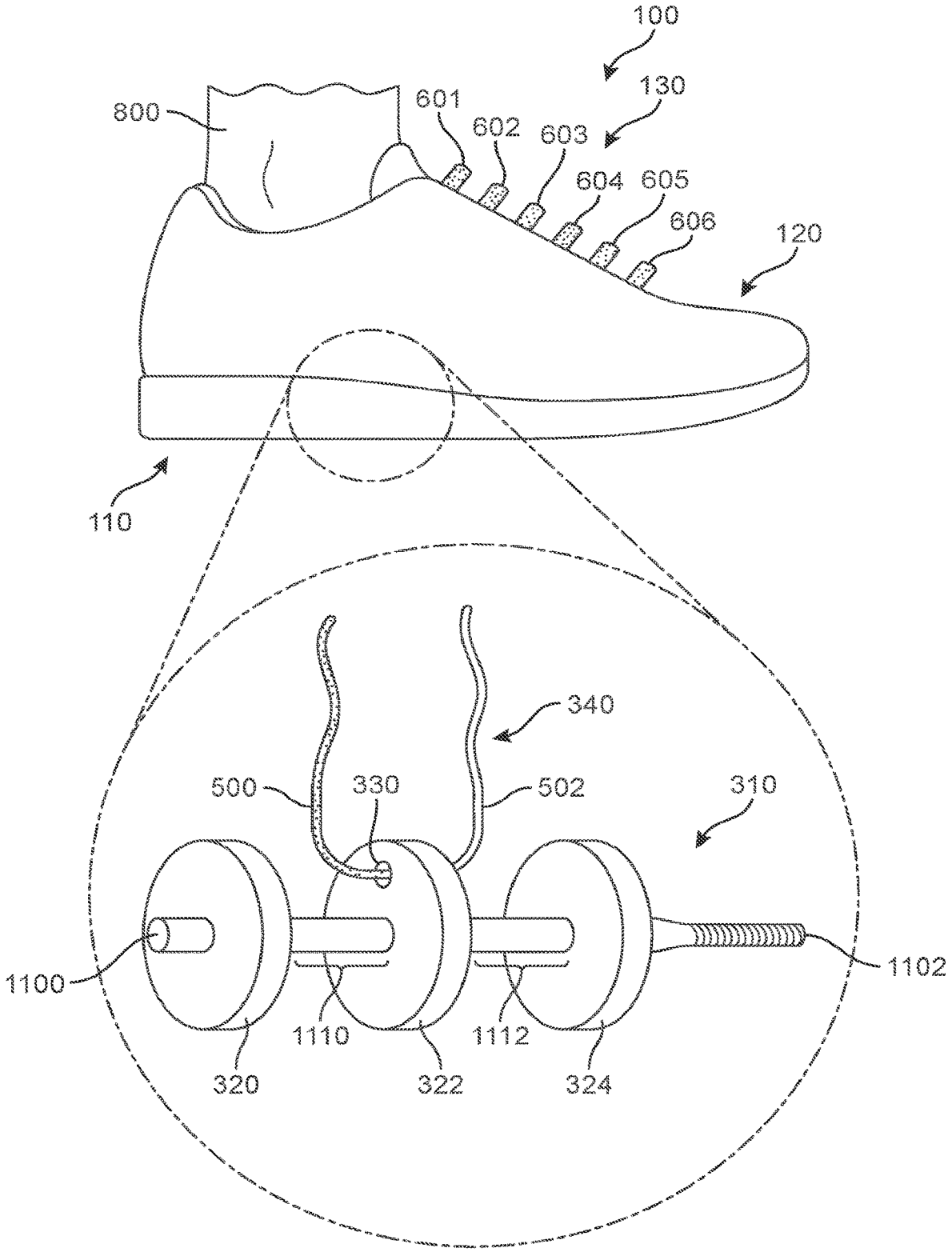
FIG. 11 is a representative view of an exemplary embodiment of a tensioning system in a loosened condition.
Figure 12:
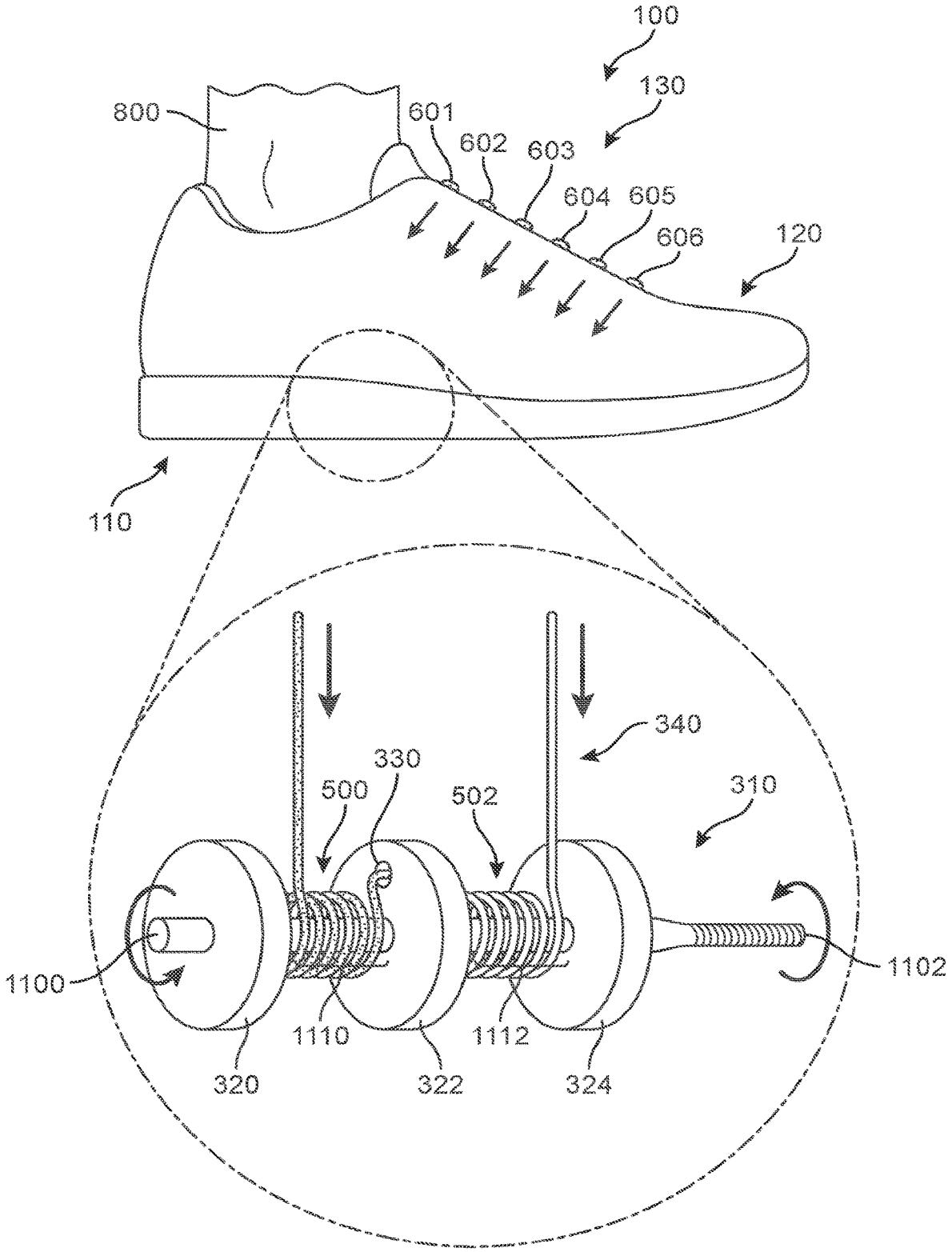
FIG. 12 is a representative view of an exemplary embodiment of a tensioning system in a tightened condition.

In some embodiments, tensioning system 300 is operable to be controlled between at least a tightened condition and a loosened condition to adjust the tension applied to lacing system 130 to transition lacing system 130 between closed and opened positions. In different embodiments, however, it should be understood that tensioning system 300 may be controlled to be placed into various degrees or amounts of tension that range between a fully tightened and a fully loosened condition. In addition, tensioning system 300 may include predetermined tension settings or user-defined tension settings. FIGS. 11 and 12 illustrate exemplary embodiments of tensioning system 300 being operated between a loosened condition (FIG. 11) and a tightened condition (FIG. 12). It should be understood that the method of tightening and/or loosening tensioning system 300 using tensioning assembly 302 may be performed in reverse order to loosen tensioning system 300 from the tightened condition to the loosened condition.

In some embodiments, tensioning system 300 includes a reel member 310. Reel member 310 is a component within tensioning assembly 302 of tensioning system 300. Reel member 310 is configured to be rotated around a central axis in opposite directions to wind and/or unwind lace 340 and thereby tighten or loosen tensioning system 300 and adjust tension in lacing system 130 between a closed position and an opened position.

In an exemplary embodiment, reel member 310 has a central axis that extends along a longitudinal length of reel member 310 from a first end 1100 to a second end 1102. Reel member 310 is a reel or spool having a shaft running along the central axis and a plurality of flanges extending radially outward from the shaft. The plurality of flanges can have a generally circular or round shape with the shaft disposed within the center of each flange. The flanges assist with keeping the wound portions of lace 340 separated and organized on reel member 310 so that lace 340 does not become tangled or bird-nested during winding or unwinding when tensioning system 300 is tightened or loosened. As described above, reel member 310 is configured to rotate about the central axis in a first rotational direction and an opposite second rotational direction to wind or unwind lace 340 around portions of the shaft.

In an exemplary embodiment, reel member 310 may include a center flange 322 located approximately at a midpoint along the shaft of reel member 310. Center flange 322 may include an aperture 330 that forms an opening extending between opposite faces of center flange 322. Aperture 330 is configured to receive lace 340. As shown in FIG. 11, lace 340 extends through aperture 330 in center flange 322 from one side or face of center flange to the other side or opposite face. With this arrangement, portions or segments of lace 340 are disposed on opposite sides of center flange 322 and lace 340 is interconnected to reel member 310 and tensioning assembly 302. When lace 340 is disposed through aperture 330 of center flange 322, lace 340 may include first lace segment 500 located on one side of center flange 322 and second lace segment 502 located on the opposite side of center flange 322.

In one embodiment, reel member 310 may include at least three flanges on the shaft. In this embodiment, reel member 310 includes a first end flange 320, center flange 322, and a second end flange 324. Center flange 322 is located along the shaft between first end flange 320 and second end flange 324. First end flange 320 and second end flange 324 are located on the shaft at opposite ends of reel member 310 on either side of center flange 322. First end flange 320 and/or second end flange 324 may assist with keeping portions or segments of lace 340 that are wound on reel member 310, including first lace segment 500 and/or second lace segment 502, from sliding off the ends of reel member 310 and may also assist with preventing lace 340 from becoming tangled or bird-nested during winding or unwinding when tensioning system 300 is tightened or loosened.

In some embodiments, portions of the shaft of reel member 310 may be described with reference to the plurality of flanges extending away from the shaft. For example, a first shaft section 1110 extends between first end flange 320 and center flange 322 and a second shaft section 1112 extends between second end flange 324 and center flange 322.

In an exemplary embodiment, center flange 322 includes aperture 330, described above. Aperture 330 extends between opposite sides or faces of center flange 322 and provides an opening that allows lace 340 to extend between the opposite sides or faces of center flange 322 to interconnect with reel member 310 and tensioning assembly 302. In some embodiments, center flange 322 extends radially outward from shaft and aperture 330 is located on center flange 322 so as to be spaced apart from the shaft. In this embodiment, aperture 330 is located adjacent to a perimeter edge of center flange 322. In different embodiments, the distance between the perimeter edge of center flange 322 and the location of aperture 330 may vary. For example, the distance may be determined on the basis of revolution rate of tensioning assembly 302 and/or the motor or may be determined on the basis of the desired tension within tensioning system 300 and lacing system 130.

Reel member 310 is operable to be rotated in the first rotational direction or the second rotational direction to wind or unwind lace 340 and thereby tighten or loosen tensioning system 300. Tension on each of first lace segment 500 and second lace segment 502 by tensioning system 300 causes lacing system 130 to transition between the opened position and the closed position. For example, a motor and/or an associated control unit of tensioning system 300 can be used to control rotation of reel member 310, including automatic operation and/or based on user inputs. When tensioning system 300 is tightened, reel member 310 rotates while lace 340 is interconnected to center flange 322 at aperture 330. This rotation causes first lace segment 500 and second lace segment 502 to be wound onto portions of the shaft on opposite sides of center flange 322. Specifically, first lace segment 500 is wound onto first shaft section 1110 and second lace segment 502 is wound onto second shaft section 1112.

Referring again to FIG. 11, an exemplary embodiment of tensioning system 300 in a loosened condition is illustrated. In this embodiment, a foot 800 of a wearer is inserted into article 100 with tensioning system 300 in an initially loosened condition. In the loosened condition, lacing system 130 and plurality of strap members 136 are unfastened or in an opened position to allow entrance of foot 800 within the interior void of upper 120. Lace 340 is connected to strap members 136 of lacing system 130 and is also interconnected to reel member 310 of tensioning assembly 302 by being disposed through aperture 330 in central flange 322 of reel member 310. With this arrangement, winding of lace 340 around portions of reel member 310 will cause tension in lace 340 to pull plurality of strap members 136 of lacing system 130 to a closed position at each of the lace positions and tighten upper 120 around foot 800 when tensioning system 300 is in the tightened condition.

For example, in this embodiment, plurality of strap members 136 associated with first lace position 601, second lace position 602, third lace position 603, fourth lace position 604, fifth lace position 605, and sixth lace position 606 are shown loosened when lacing system 130 is in the opened position. This allows a wearer to insert or remove foot 800 into or out of upper 120.

FIG. 12 illustrates an exemplary embodiment of tensioning system 300 in a tightened condition. In this embodiment, tensioning assembly 302 rotates reel member 310 in the first rotational direction (e.g., counterclockwise) about the central axis to apply tension to lace 340 and tighten tensioning system 300. The interconnection of lace 340 to central flange 322 through aperture 330 causes first lace segment 500 to wind around first shaft section 1110 and second lace segment 502 to wind around second shaft section 1112 when reel member 310 is rotated in the first rotational direction. The tension applied to lace 340 and transmitted from lace 340 to plurality of strap members 136 moves lacing system 130 to a closed position to secure upper 120 around foot 800 when tensioning system 300 is in the tightened condition.

Similarly, rotation of reel member 310 can be made in the opposite second rotational direction to unwind lace 340 from portions of the shaft to return tensioning system 300 to the loosened condition and move lacing system 130 back to the opened position, as shown in FIG. 11 above. In addition, in some embodiments, rotation of reel member 310 in the second rotational direction may be performed by a motor, by a user manually pulling on lace 340 and/or strap members 136, or both.

In an exemplary embodiment, rotation of reel member 310 in either or both of the first rotational direction and the second rotational direction will cause lace 340 to wind or unwind substantially equally around portions of the shaft of reel member 310. That is, the take up distance of first lace segment 500 wound on first shaft section 1110 and the take up distance of second lace segment 502 wound on second shaft section 1112 will be approximately equal on opposite sides of central flange 322 when tensioning system 300 is in the tightened condition. Similarly, during unwinding of lace 340 from reel member 310, approximately equal portions of lace 340 are unwound from opposite sides of center flange 322 when tensioning system 300 is placed in the loosened condition from the tightened condition. That is, the amount of first lace segment 500 unwound or spooled out from first shaft section 1110 and the amount of second lace segment 502 unwound or spooled out from second shaft section 1112 will be approximately equal.

As described above, with the lace routing patterns according to the present embodiments, the take up distance of first lace segment 500 when tensioning system 300 is in the tightened condition and lacing system 130 is in the closed position is approximately equal to the total closure distance between medial edge 134 and lateral edge 133 of lacing area 132 according to the first routing pattern. Similarly, the take up distance of second lace segment 502 when tensioning system 300 is in the tightened condition and lacing system is in the closed position is approximately equal to the total closure distance medial edge 134 and lateral edge 133 of lacing area 132 according to the second routing pattern. With this arrangement, tension within upper 120 of article 100 may be approximately uniformly distributed across lacing system 130 by tensioning system 300.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure;

an upper, secured to the sole structure, the upper forming a throat opening and a lacing area bounded by a medial edge of the upper, a lateral edge of the upper, the throat opening, and a forefoot region of the upper;

a tensioning assembly;

a lace, comprising a first lace segment and a second lace segment, the lace operatively coupled to the tensioning assembly, the lace extending across the lacing area in a plurality of lace positions, the plurality of lace positions including a first lace position that is most proximate to the throat opening relative to all other lace positions of the plurality of lace positions;

wherein the first lace segment enters the lacing area directly from the tensioning assembly, extends through the first lace position proximate the throat opening, and then crosses over a first portion of the lacing area between the throat opening and a midsection of the lacing area at least twice, wherein the first lace segment has an end secured to one of a medial side and a lateral side of the forefoot region of the upper; and wherein the second lace segment enters the lacing area, from the tensioning assembly, proximate the midsection of the lacing area and crosses over a second portion of the lacing area between the midsection and the forefoot region at least twice, wherein the second lace segment has an end, separate from the end of the first lace segment, secured to the same one of the medial and lateral sides of the forefoot region of the upper such that the end of the first lace segment and the end of the second lace segment are both separately secured to the medial side of the forefoot region or are both separately secured to the lateral side of the forefoot region.

2. The article of footwear according to claim 1, wherein the first lace segment enters the lacing area proximate the medial edge.

3. The article of footwear according to claim 2, wherein the second lace segment enters the lacing area proximate the medial edge.

4. The article of footwear according to claim 2, wherein the first lace segment crosses over the lacing area three times.

5. The article of footwear according to claim 4, wherein the second lacing segment crosses over the lacing area three times.

6. The article of footwear according to claim 1, further comprising a plurality of lacing guides positioned proximate the lacing area, each of the plurality of lacing guides receiving one of the first lacing segment and the second lacing segment.

7. The article of footwear according to claim 6, wherein each of the plurality of lacing guides extends across the lacing area.

8. The article of footwear according to claim 7, wherein at least one of the plurality of lacing guides further partially extends between the throat opening and the forefoot region.

9. The article of footwear according to claim 1, wherein the first lace segment overlaps the second lace segment on one of a medial side and a lateral side of the lacing area.

10. The article of footwear according to claim 1, wherein the lace extends along a full length of the lacing area from the throat opening to the forefoot region.

* * * * *